United States Patent [19]

Barnes, Jr.

[11] 4,213,322

[45] Jul. 22, 1980

[54] METHOD AND APPARATUS FOR UPSETTING PIPE

[75] Inventor: Floyd A. Barnes, Jr., Pittsburgh, Pa.

[73] Assignee: Youngstown Sheet and Tube Company, Pittsburgh, Pa.

[21] Appl. No.: 951,988

[22] Filed: Oct. 16, 1978

[51] Int. Cl.[2] ..... B21D 41/00

[52] U.S. Cl. ..... 72/357; 72/370

[58] Field of Search ..... 72/357, 358, 354, 353, 72/356, 367, 370

[56] References Cited

U.S. PATENT DOCUMENTS

| | | | |
|---|---|---|---|
| 760,220 | 5/1904 | Loss | 72/354 |
| 1,010,004 | 11/1911 | Wales | 72/354 |
| 1,041,998 | 10/1912 | Hansen | 72/354 |
| 2,343,403 | 3/1944 | Criley | 72/357 |

*Primary Examiner*—Francis S. Husar
*Assistant Examiner*—Gene P. Crosby

[57] ABSTRACT

Method and apparatus for handling and deforming a relatively short workpiece, such as the upsetting of a pipe to increase the wall thickness at an end thereof in preparation for forming the threads of a pup joint.

12 Claims, 8 Drawing Figures

METHOD AND APPARATUS FOR UPSETTING PIPE

BACKGROUND OF THE INVENTION

This invention is directed to method and apparatus for the handling and deforming of relatively short stock such as bars, rods, rounds, pipe, etc., (all of which may be referred to as "short work pieces") in apparatus which is initially designed to handle relatively long stock or workpieces. Preferred embodiments of the invention are particularly adapted for use in conjunction with the upsetting of pipe ends for the making of threaded joints and most particularly in conjunction with the fabrication of oil well casing pup joints, with which the invention will be described.

A pup joint is the name known in the art for a relatively short length of pipe needed, in addition to the regular lengths or strings, to attain the spacing requirement for a wellhead depth.

In the pipe art, as related to oil well casing, it is the practice to upset the pipe ends in order to increase the wall thicknesses thereof in preparation for the thread cutting of pin or box ends of pipe joints. The upsetting is conducted in an upsetting machine comprising a pair of dies, each of which defines a semi-circular cavity for receiving the pipe. In order to upset or swage a pipe end it must first be heated to swaging temperature. This is usually done by conveying the pipe along a path such that the end to be forming by upsetting is conducted through a reheat furnace and then directly to the upsetting machine. The transport means for transporting the pipe through and from the reheat furnace to the upsetting machine is adapted to handle relatively long pipe, i.e., 16 feet and longer, the shortest length in the Range 1 of the API specification for casing. In one known installation, considered to be typical, a series of four rails are provided to serve as the transport means; three of the rails are on eight feet centers with the rail nearest the machine being about six feet—six inches from the next adjacent rail and about nine feet—six inches from the face of the dies of the upsetting machine. Therefore, pipe lengths under ten feet in length require special handling. Tubing or other relatively light pipe members can be handled manually; however, casing, which is relatively heavy, can not be easily handled. Consequently, relatively short lengths of casings which are upset at both ends, such as pup-joints, are not handled or processed in the same manner as are the longer lengths.

It has not been possible to upset both ends of a pup joint in heretofore known existing upsetting machines because the dies could not accommodate an existing upset end while the opposite end is being upset. Heretofore, pup joints with increased wall thickness at the threaded ends have been fabricated by machining a solid round bar, or an extra-heavy wall pipe, having an outside diameter corresponding to outside diameter of the desired upset portion. It becomes apparent that such machining is not only wasteful of stock material but also time consuming and expensive. Also, because of the machinery requirements it is not always possible to fabricate such pup joints from compositions having the same chemistries as the compositions from which the regular pipes are fabricated. The maintenance of chemical homogeneity through a pipe string is important in wells where the string is exposed to hydrogen sulfide.

OBJECTS AND SUMMARY OF THE INVENTION

It is an object of this invention to provide new and improved method and apparatus for handling and upsetting short workpieces.

It is another object to provide more simple and facile method and apparatus for advancing a short length of pipe along support rails spaced apart a distance greater than the length of the pipe.

It is a further object to provide method and apparatus for upsetting the end of a short length of pipe opposite an end of said pipe which has been previously upset.

It is another object to provide an upsetting machine and method of utilizing existing string length casing upsetting machines to adapt them for upsetting casing pup joints.

In accordance with this invention, a method is provided for adapting and utilizing existing conventional upsetting machines and related pipe conveying lines to handle and process relatively short lengths of pipe, which previously could not be processed in such machines. In brief, the objects of this invention are attained by securing an extension to the upset end of a short length of pipe, heating the opposing end to swaging temperature, and transporting the pipe to an upsetting machine which has been modified to adapt the machine to receive the entire length of the pipe and to suitably secure the pipe so that the opposing end can be upset. In a preferred embodiment, a conventional upset machine is modified by foreshortening the gripping section of the die cavity, providing additional means to compensate for the foreshorten gripping, providing an enlarged die cavity portion for receiving therein an upset end of a pipe, and providing extension means for the pipe to facilitate handling and support of the pipe in the die cavity. In a further preferred embodiment, the gripping section is modified by foreshortening the die insert portions, back-up ring means are provided to increase resistance to axial movement of the die inserts during the swaging step, and additional gripping means are provided for holding the pipe extension aft of the die cavity.

DESCRIPTION OF THE DRAWING

The invention will be more fully understood and further objects and attendant advantages will become more apparent when reference is made to the following detailed description of prior art and of preferred embodiments and to the accompanying drawings in which.

DESCRIPTION OF PRIOR ART

Figure 1:
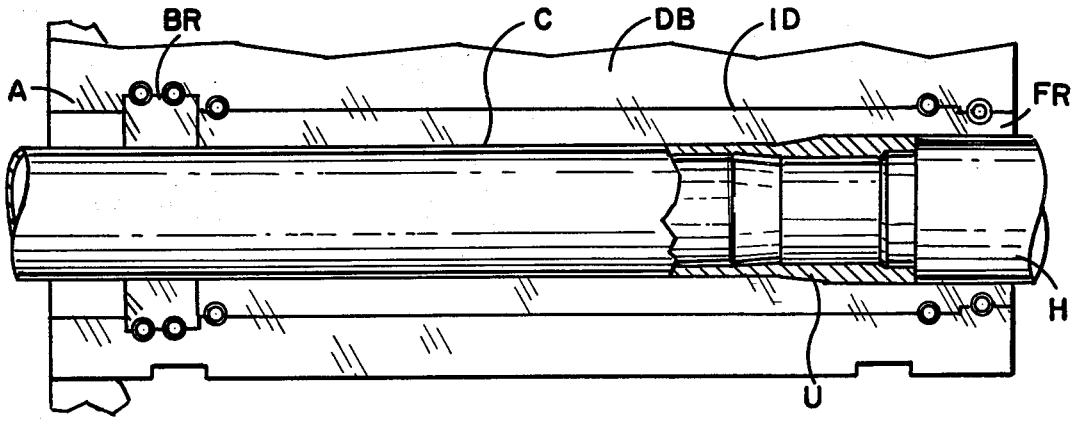
FIG. 1 (PRIOR ART)
FIG. 1 is a side elevational view of one of the pair of die blocks comprising a prior art upsetting machine.

In FIG. 1, there is shown a first die block DB of a pair comprising a prior art upsetting machine UM. The opposing die block is a mirror image of the first and hence need not be shown for an understanding of the description.

The die block DB defines a semi-cylindrical cavity C. It will be noted that the cavity is substantially uniform across the longitudinal extent of the die block except for a short extent at the fore or swager entrance terminus F which has a reduced radius and for a short extent at the opposite or aft end A. The cavity portion of reduced radius defines a ledge which facilitates positioning of the die insert while the enlarged cavity portion is adapted to receive a back-up ring element BR to resist axial movement of the die insert during the swaging procedure. There is no provision for receiving a previously upset end of a pipe; therefore, in order to produce a pipe having both of its ends upset, the pipe must be longer than the die block of the upsetting machine. Such die blocks are usually in the order of 52 inches long and the longitudinal extent of an upset portion of the pipe might be 10 inches long. Thus the pipe in such cases would have to be at least 62 inches long (allowing for part of the swaging head to be within the die before upsetting) to be handled by the upset machine. However, in order to be handled on typical transport lines from the heating furnace to the upset machine, where the spacing between the first and second rails is 6 feet 6 inches and the spacing between the second and third rails is 8 feet, the pipe would have to be in the order of 15 feet long.

DESCRIPTION OF PREFERRED EMBODIMENTS

The present invention obviates the problems attendant with the prior art upsetting machines and methods of handling relatively short lengths of pipe, particularly those which are upset at one end and which are to be upset at the opposing end.

Figure 2:
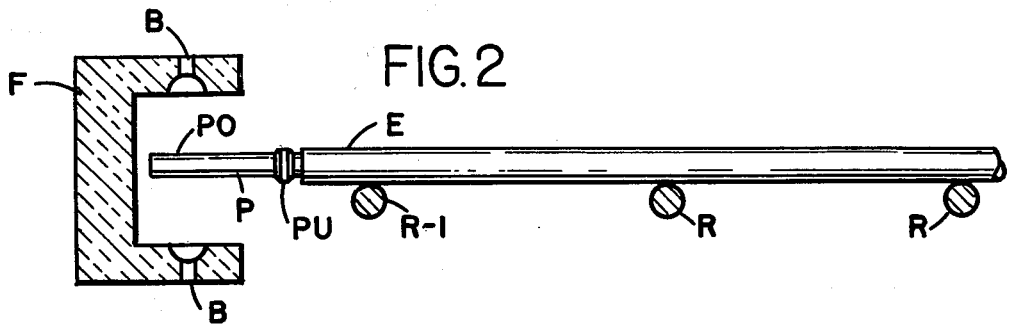
FIG. 2 is a schematic representation of an elevational view of a relatively short length of pipe with an extension secured thereto for advancement through a reheat furnace.

Referring more particularly to the drawing, in FIG. 2, there is schematically illustrated a plurality of skid rails R. The rails R are shown as inclined pipes whereby the pipe P to be processed may be advanced through the furnace F for heating of the pipe end PO, as by burners B. In a typical installation the skid R-1 will be about 2 ½ feet from the furnace and about 8 feet from the center of the next skid R; all of the skids R are generally spaced on about 8 feet centers.

Since the present invention is directed to method and apparatus for processing relatively short or pup lengths of pipe P and is particularly adaptable for processing pipe on existing lines having established die block lengths in the upsetting machine, provision must be made to accomodate an upset end PU of the pipe within the die block so as to avoid mutilating the previously upset end PU. Any foreshortening of the die block cavity is not a solution, per se, to the processing of short lengths of pipe. With a foreshortening of the die block or the die block inserts there is an attendant reduction in the gripping zone or area. The gripping zone is one wherein the die insert halves, when in closed position, are in sufficient close contact with the pipe so as to "bite" the pipe and resist axial displacement during the impact of the swaging head H. It must be recognized that at the forward or upset header entrance end EH of the die the pipe is not in close contact with the die insert walls defining the die cavity. Space allowance must be made for the pipe to be expanded outwardly to define the upset configuration and also to provide for heat relief or dissipation in the "run-out" or transition zone TZ between the expanded or increased wall thickness zone WT to the normal diameter of the pipe. A back-up halfring G-1 for the die inserts ID is provided which also functions as first gripping means for the pipe. Additionally, gripping means G-2 for the pipe extension is provided, which for convenience of description may be designated as second gripping means. The adapter, EA, between the pipe and the pipe extension E, also defines back-stop means BS for the pipe. The back-stop means BS, being secured by the second gripping means G-2, also serves to block axial displacement of the pipe P when it is being swaged. Preferably, the half-ring forming the first gripping means G-1 is recessed or step formed into the die block in a manner which provides additional resistance to axial movement not only of the gripper means but also of the die inserts. The second gripping means G-2 is also preferably recessed into the die so as to form a wedge or step formation. Also, the surface area mating with the pipe extension is extended axially to provide additional bite. In a preferred embodiment, the pipe extension E has an outside diameter larger than that of pipe P in order to provide increased surface contact between the pipe extension and the second gripping means and thereby increase the "bite".

It will be understood in the art that although the box end of a pipe casing is illustrated in the drawing as the one being formed the pin end of the casing may be formed in similar means by providing the proper configuration of die inserts and of a corresponding swaging or upsetting head.

In a preferred embodiment of processing, a typical relatively long length of seamless casing pipe may be processed in the regular manner to upset a first end of the pipe, which may be either the box or pin end. After upsetting, the pipe is cut to a length slightly longer (generally 4 to 6 inches) than that of the desired final pup-joint. As may be seen in FIG. 4, a pipe extension E, having an inside diameter portion corresponding generally to the outside diameter of the terminus of the upset portion U of the pipe P, is placed over the pipe and suitably secured thereto, as by setscrews S. A mandrel M, having a pilot nose portion N is provided and secured to the pipe extension E. The mandrel M has an outside diameter corresponding generally to the inside diameter of the upset portion of the pipe P and provides internal support for the pipe. Preferably, for ease in handling the pipe for heating in the furnace F, (FIG. 2) the pipe extension should be long enough to span three of the rails R and extend the pipe into the heating zone of the furnace F; in a typical installation the rails R are about 8 feet apart, therefore the extension is usually at least 20 feet long and preferably longer when processing pup joints of less than 5 feet length.

Figure 3:
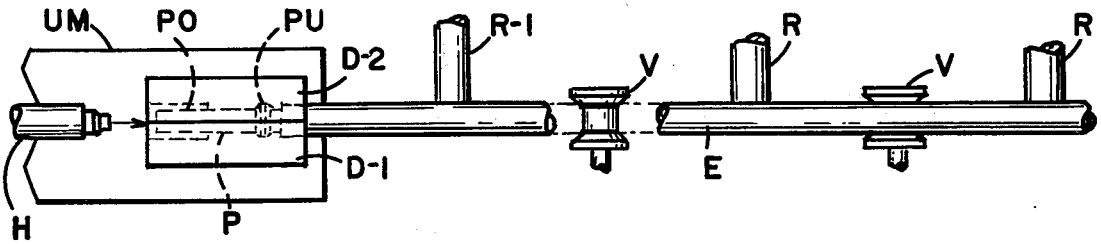
FIG. 3 is a plan view of the upsetting machine of this invention together with a pipe and its extension.
Figure 5A:
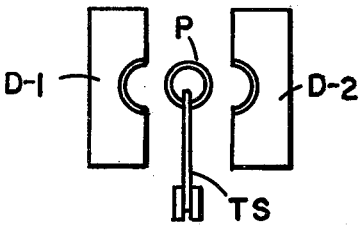
FIGS. 5A, 5B, and 5C are schematic end views of the die halves illustrating the positioning thereof and of the pipe preparatory to the upsetting step.
Figure 5B:
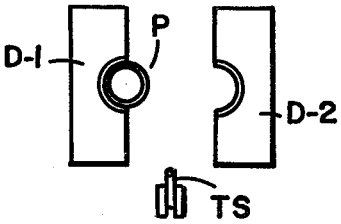
Figure 5C:
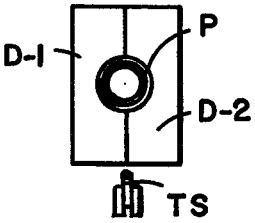
Figure 6:
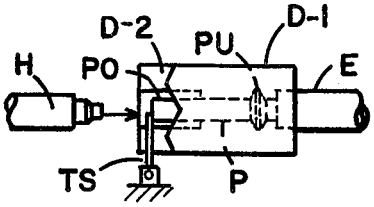
FIG. 6 is a fragmentary and schematic side elevational view of the die block as shown in FIG. 3.

After being heated in the furnace F the pipe moves to the upset machine UM (FIG. 3), where the pipe P is transferred by a series of V-groove shaped rollers V from and transversely of the skid rails R to the station between the two halves of the die block. The movement of the pipe P as schematically illustrated in FIGS. 5A, 5B, 5C is sensed by appropriate means, such as trip switch TS, which when tripped actuates suitable controls which in turn stop the movement of the pipe P between the die halves D-1 and D-2 (FIG. 5A). The pipe P is then positioned against a first, D-1, of the die halves (FIG. 5B), which may be stationary, and then the other die half D-2 is brought up against the pipe P and the first die half D-1 (FIG. 5C).

Figure 4:
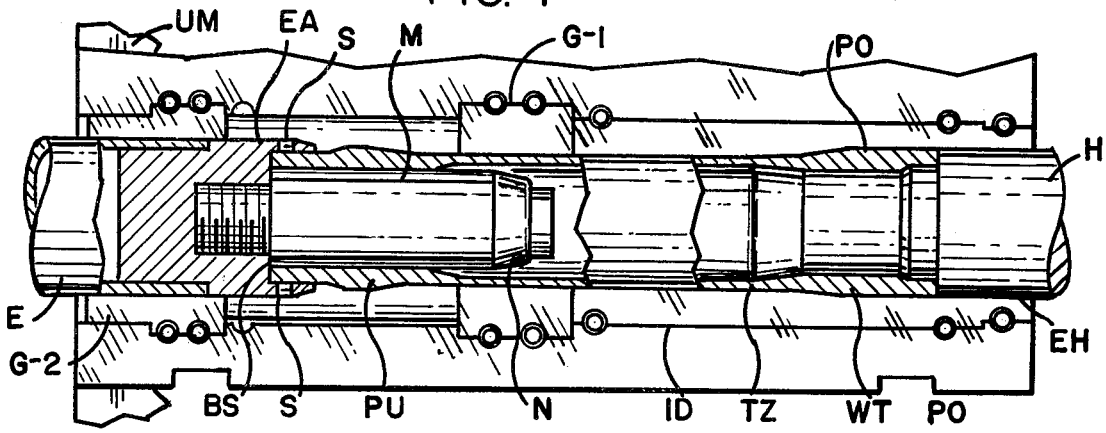
FIG. 4 is an enlarged side elevational view of one of the dies of the pair of dies comprising the upsetting machine and which pair when together define the cylindrical die cavity in which the pipe is shown in the upset condition.

The pipe end PO is then upset by applying pressure thereto with the upsetting or swaging head H which may be activated by suitable means such as a crank (not shown). The application of pressure to the end of the pipe foreshortens it and increases the wall thickness in a manner such as shown in FIG. 4. In some cases where the wall thickness is to be increased a substantial amount the upsetting and forming of the pipe P may be done in two separate passes or stages; the first stage being one in which the diameter of the pipe end is essentially expanded and the second stage being one in which the metal is displaced axially and the final desired configuration is imparted.

After being upset the pipe P may be threaded by the conventional techniques known and accepted in the art.

From the foregoing description it will be seen that the present invention obviates the need for huge capital investments by pipe casing manufacturers for facilities, separate from those used for processing relatively long casing strings, to process relatively short strings known as pup joints. Further, method and apparatus are provided whereby both ends of pup joints 5 feet long or less may be upset to provide increased wall thicknesses, and from pipe stock having the same characteristics as the regular lengths of pipe in a well string of pipes; this, is contradistinct from pup joints having step formation end sections formed by machine removal of metal.

The present invention provides method and apparatus for upset forming casing pup joints whereby the entire length of the pup joint may be positioned within the axial cavity of a die; the cavity having an enlarged diameter portion to accommodate an enlarged or upset end of the casing; the enlarged cavity portion being between first and second gripping means; the first gripping means being between the enlarged cavity portion and the upset form defining portion UF of the die; the second gripping means being at the axial cavity end opposite the upset form defining portion end.

Among the other advantages that accrue from the invention described herein are:

A method is provided for converting a conventional pipe upsetting machine to multi-purpose machines capable of upsetting both ends of pipe having a length shorter than the axial extent of the die cavity of the machine;

A method for transporting a relatively short length of pipe on transport systems in conjunction with pipe upsetting apparatus, which systems were originally designed to transport relatively long pipe, i.e., at least longer than the axial extent of the die cavity of the upsetting machine;

Method and apparatus are provided for upsetting pup-joint lengths of pipe in a more facile and heretofore unattainable manner and satisfy a long felt need toward obviating the machine cutting of extra heavy wall pipe or solid bars in producing pup-joints of short lengths.

I claim:

1. A method of upsetting one end of a pipe having an enlarged opposite end, which method comprises:

placing said pipe in an upset die cavity having an upset header entrance end, said cavity having an axial extent longer than said pipe with said enlarged end being within an enlarged cavity portion;

gripping the circumference of said pipe by means positioned within said die and between said enlarged cavity portion and said upset header entrance end; and inserting an upset header and moving it axially inwardly of said die to axially displace part of the terminal portion of said pipe and through the cojoint action of the upset header and said die enlarging the wall thickness of said pipe at said one end.

2. A method as described in claim 1, which comprises:

supporting said enlarged end of said pipe with an extension member extending therefrom to the corresponding axial end of said die; and gripping said extension member with circumposing means to resist axial displacement of said extension member.

3. A method as described in claim 2, which comprises:

blocking axial movement at the axial terminus of said pipe at the enlarged end thereof.

4. Apparatus for upset forming one end of a pipe having an enlarged opposite end, which apparatus comprises:

die means defining an axially extending cavity having a diameter through a substantial portion of its axial extent corresponding substantially to the diameter of the pipe to be upset;

said die having an enlarged cavity portion for receiving said enlarged end;

upset header means including a portion defining together with said die means at the header entrance end of said cavity the configuration of the form to be imparted to said one end; and first gripping means, along said cavity between said enlarged cavity portion and said header entrance end, circumposing and for resisting axial movement of said pipe.

5. Apparatus as described in claim 4, wherein:

said die means includes a step-formation for receiving said first gripping means and the combination thereof resists axial movement of said first gripping means.

6. Apparatus as described in claim 4, wherein:

said die means includes inserts defining a substantial portion of said axial cavity; and said first gripper means also forms means for resisting movement of said inserts during axial movement of said upset header means.

7. Apparatus as described in claim 4 further comprising:

pipe extension means having a mandrel for supporting said enlarged opposite end; and second gripping means, at the end of the cavity opposing said header entrance end, circumposing and for resisting axial movement of said pipe extension means.

8. Apparatus as described in claim 7, wherein said pipe extension means includes:

adapter means for connecting said mandrel to the main body portion of said pipe extension means.

9. Apparatus as described in claim 8, wherein said adapter means includes:

back-stop means for resisting axial movement of said pipe during axial movement of said upset header means.

10. Apparatus for inserting into and withdrawing pipe from an upsetting machine, the pipe having an upset end, which apparatus comprises:

an elongate cylindrical member forming an extension for said pipe from said upset end;

adapter means forming a secured connection between said pipe and said extension and including stop means for opposing axial movement of said pipe at said upset end while the opposite end is being upset.

11. Apparatus as described in claim 10, wherein said adapter means includes:

mandrel means for internally supporting said upset end.

12. Apparatus for upsetting one end of a pipe having an enlarged opposite end, which apparatus comprises:

die block means defining an axially extending cavity and having die inserts therein;

upset header means including a portion, at the header entrance end of said die block means, defining together with said die inserts the configuration of the form to be imparted to said one end;

said cavity having a portion adapted to receive said enlarged end of said pipe;

first gripping means, along said cavity between the enlarged end receiving portion and said header entrance end, circumposing and for resisting axial movement of said pipe;

pipe extension means including an elongate cylindrical main body portion, and adapter means for connecting said pipe to said-main body portion of said extension means and a mandrel for said opposite end, said adapter means also defining stop means for opposing axial movement of said pipe at said opposite end while said one is being upset; and second gripping means, at the end of said cavity opposing said header entrance end, circumposing and for resisting axial movement of said pipe extension means.

* * * * *